US010235829B2

(12) United States Patent
Johnson et al.

(10) Patent No.: US 10,235,829 B2
(45) Date of Patent: Mar. 19, 2019

(54) SYSTEM AND METHOD OF ALLOWING A PLAYER TO PLAY GAMING MACHINES HAVING ROTATING SYMBOL AND COLUMN REPLICATION

(71) Applicant: Konami Gaming, Inc., Las Vegas, NV (US)

(72) Inventors: Bradley A. Johnson, Henderson, NV (US); Jason Gilmore, Las Vegas, NV (US)

(73) Assignee: Konami Gaming, Inc., Las Vegas, NV (US)

( * ) Notice: Subject to any disclaimer, the term of this patent is extended or adjusted under 35 U.S.C. 154(b) by 0 days.

(21) Appl. No.: 14/628,994

(22) Filed: Feb. 23, 2015

(65) Prior Publication Data

US 2015/0348363 A1 Dec. 3, 2015

(51) Int. Cl.
*G07F 17/32* (2006.01)
*G07F 17/34* (2006.01)

(52) U.S. Cl.
CPC ..... *G07F 17/3213* (2013.01); *G07F 17/326* (2013.01); *G07F 17/3244* (2013.01); *G07F 17/34* (2013.01)

(58) Field of Classification Search
CPC ... G07F 17/3267; G07F 17/34; G07F 17/3213
See application file for complete search history.

(56) References Cited

U.S. PATENT DOCUMENTS 6,220,959 B1 4/2001 Holmes, Jr. et al.
6,517,432 B1 * 2/2003 Jaffe ..... G07F 17/32 463/16
6,796,903 B1 * 9/2004 Bryant ..... G07F 17/3244 273/139
6,855,054 B2 2/2005 White et al.
7,070,502 B1 * 7/2006 Bussick ..... G07F 17/34 463/20
7,749,082 B2 7/2010 Dunaevsky et al.
7,758,414 B1 * 7/2010 Marks ..... G07F 17/3211 273/138.1
8,002,631 B2 8/2011 Thomas et al.
8,075,392 B2 12/2011 Richardson
8,177,628 B2 5/2012 Manning et al.
(Continued)

OTHER PUBLICATIONS

Patent Examination Report No. 1 (AU 2014202894); dated Jul. 2, 2014.

*Primary Examiner* — Robert T Clarke, Jr.

(74) *Attorney, Agent, or Firm* — Howard & Howard Attorneys PLLC

(57) ABSTRACT

The invention is directed to a gaming machine and method of providing a game. The game machine comprises a display and a controller. The display is configured to display a plurality of symbol positions displayed in a grid. The controller is configured to: initiate a game and define an initial result, the initial result including a symbol in each of the symbol positions within the grid; detect a trigger condition, the trigger condition being a collection of the same symbol within every position of the grid along a first axis; determine at least one adjacent axis from the first axis as a function of predetermined criteria; and copy the same symbol into at least one predetermined position along the adjacent axis.

20 Claims, 14 Drawing Sheets

(56) References Cited

U.S. PATENT DOCUMENTS 8,226,468 B2 * 7/2012 Hoffman ..... G07F 17/3244 463/20
8,585,487 B2 11/2013 Rodgers et al.
8,784,176 B2 * 7/2014 Ryan ..... G07F 17/3262 273/138.1
8,939,832 B2 * 1/2015 Ryan ..... G07F 17/34 463/16
2001/0003710 A1 * 6/2001 Abramopoulos .... G06G 1/0005 463/27
2002/0052233 A1 * 5/2002 Gauselmann ..... G07F 17/3265 463/20
2003/0203752 A1 * 10/2003 Kaminkow ..... G07F 17/32 463/20
2003/0203753 A1 * 10/2003 Muir ..... G07F 17/32 463/20
2005/0130737 A1 * 6/2005 Englman ..... G07F 17/32 463/25
2006/0246977 A1 * 11/2006 Cannon ..... G07F 17/34 463/13
2008/0058060 A1 3/2008 Okada
2008/0167115 A1 * 7/2008 Singer ..... G07F 17/3286 463/20
2008/0188280 A1 * 8/2008 Marks ..... G07F 17/34 463/20
2008/0188286 A1 8/2008 Jaffe
2009/0104963 A1 * 4/2009 Burman ..... G07F 17/3223 463/18
2009/0186686 A1 * 7/2009 Shai-Hee ..... G07F 17/3265 463/20
2009/0253491 A1 * 10/2009 Gomez ..... G07F 17/3227 463/20
2009/0286588 A1 * 11/2009 Jackson ..... G07F 17/34 463/20
2009/0325678 A1 * 12/2009 Gomez ..... G07F 17/34 463/20
2010/0113132 A1 * 5/2010 Sasaki ..... G07F 17/32 463/20
2010/0304831 A1 * 12/2010 Suda ..... G07F 17/34 463/20
2011/0136562 A1 * 6/2011 Loat ..... G07F 17/3265 463/20
2012/0115570 A1 * 5/2012 Collette ..... G07F 17/326 463/20
2013/0065663 A1 * 3/2013 Johnson ..... G07F 17/3213 463/20
2013/0065664 A1 * 3/2013 Clemens ..... G07F 17/3267 463/20
2013/0344939 A1 * 12/2013 Aoki ..... G07F 17/326 463/21
2014/0057705 A1 * 2/2014 Elias ..... G07F 17/3244 463/25
2014/0179398 A1 * 6/2014 Vandaele ..... G07F 17/326 463/20
2014/0221075 A1 * 8/2014 Lee ..... G07F 17/32 463/20
2014/0221079 A1 * 8/2014 Rucker ..... G07F 17/3267 463/21
2014/0274285 A1 * 9/2014 Meyer ..... G07F 17/34 463/20
2014/0274316 A1 * 9/2014 Elias ..... G07F 17/34 463/25
2015/0339880 A1 * 11/2015 Zurawski ..... G07F 17/34 463/20

* cited by examiner

| Table 1 - Symbol For Rotation | | |
|---|---|---|
| **Symbol** | **Weight** | **Probability** |
| Top | 1 | 33.3333% |
| Middle | 1 | 33.3333% |
| Bottom | 1 | 33.3333% |
| | **3** | **100.0000%** |

FIG. 9

| Table 2- Direction of Rotation | | |
|---|---|---|
| Direction | Weight | Probability |
| Clockwise (CW) | 1 | 50.0000% |
| Counter-CW | 1 | 50.0000% |
| | **2** | **100.0000%** |

FIG. 10

| Table 3 - Angle of Rotation | | |
|---|---|---|
| Angle | Weight | Probability |
| 45 | 1 | 12.5000% |
| 90 | 1 | 12.5000% |
| 135 | 1 | 12.5000% |
| 180 | 1 | 12.5000% |
| 225 | 1 | 12.5000% |
| 270 | 1 | 12.5000% |
| 315 | 1 | 12.5000% |
| 360 | 1 | 12.5000% |
| | **8** | **100.0000%** |

FIG. 11

| Table 4 - Paste Positions | | |
|---|---|---|
| **Position** | **Weight** | **Probability** |
| Top (T) | 1 | 14.2857% |
| Middle (M) | 1 | 14.2857% |
| Bottom (B) | 1 | 14.2857% |
| Top & Middle | 1 | 14.2857% |
| Top & Bottom | 1 | 14.2857% |
| Middle & Bottom | 1 | 14.2857% |
| T, M & B | 1 | 14.2857% |
| | **7** | **100.0000%** |

FIG. 12

| Table 5 - Re-Draw Paste Probabilities* | |
|---|---|
| **Position** | **Probability** |
| Top | 33.3333% |
| Middle | 50.0000% |
| Bottom | 33.3333% |

FIG. 13

| Table 6a - Initial Activation Reel* | | |
|---|---|---|
| Reel | Weight | Probability |
| Leftmost Reel | 1 | 50.0000% |
| Rightmost Reel | 1 | 50.0000% |
| | 2 | 100.0000% |

FIG. 14

| Table 6b - Initial Activation Reel* | | |
|---|---|---|
| Reel | Weight | Probability |
| Leftmost Reel | 1 | 33.3333% |
| Middle Reel | 1 | 33.3333% |
| Rightmost Reel | 1 | 33.3333% |
| | 3 | 100.0000% |

FIG. 15

SYSTEM AND METHOD OF ALLOWING A PLAYER TO PLAY GAMING MACHINES HAVING ROTATING SYMBOL AND COLUMN REPLICATION

CROSS REFERENCE TO RELATED APPLICATION

This application claims priority to Australian Patent Application No. 2014202894, filed May 28, 2014, the disclosure of which is hereby incorporated by reference in its entirety.

COPYRIGHT NOTICE

A portion of this disclosure contains material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The invention generally relates to gaming machines and more particularly, to an apparatus and method for allowing players to play gaming machines having expanding symbol and column replication.

BACKGROUND OF THE INVENTION

Gaming machines, such as slot machines, are a cornerstone of the gaming industry. At least some known gaming machines include a video display device to display a reel game that includes a plurality of reels, wherein each reel includes a plurality of symbols. During game play, the gaming machine accepts a wager from a player, the player selects one or more paylines, the gaming machine spins the reels, and sequentially stops each reel to display the generated combination of symbols on the reels. The gaming machine then awards the player an award based on the combination of symbols orientated along the selected payline.

Some known gaming machines have a plurality of symbols displayed on their reels and utilize one unified pattern over the course of gameplay. This unified pattern progresses over time in order to provide interactive gameplay to the player. Further, additional symbols may be used in order to alter this pattern over time based on certain triggers in a game.

The present invention is aimed at one or more of the problems identified above.

BRIEF SUMMARY OF INVENTION

In one aspect of the present invention, a game machine is provided. The game machine comprises a display and a controller. The display is configured to display a plurality of symbol positions displayed in a grid. The controller is configured to: initiate a game and define an initial result, the initial result including a symbol in each of the symbol positions within the grid; detect a trigger condition, the trigger condition being a collection of the same symbol within every position of the grid along a first axis; determine at least one adjacent axis from the first axis as a function of predetermined criteria; and copy the same symbol into at least one predetermined position along the adjacent axis.

In another aspect of the present invention, a method of implementing a game machine is provided. The method includes a display and a controller. The display is configured to display a plurality of symbol positions displayed in a grid. The method includes the steps of: initiating a game and defining an initial result, the initial result including a symbol in each of the symbol positions within the grid; detecting a trigger condition, the trigger condition being a collection of the same symbol within every position of the grid along a first axis; determining at least one adjacent axis from the first axis as a function of predetermined criteria; and copying the same symbol into at least one predetermined position along the adjacent axis.

In another aspect of the present invention, a non-transitory information recording medium containing a computer readable program that functions as a game machine is provided. The game machine comprises a display and a controller. The display is configured to display a plurality of symbol positions displayed in a grid. The controller is configured to: initiate a game and define an initial result, the initial result including a symbol in each of the symbol positions within the grid; detect a trigger condition, the trigger condition being a collection of the same symbol within every position of the grid along a first axis; determine at least one adjacent axis from the first axis as a function of predetermined criteria; and copy the same symbol into at least one predetermined position along the adjacent axis.

BRIEF DESCRIPTION OF THE DRAWINGS

Other advantages of the present invention will be readily appreciated as the same becomes better understood by reference to the following detailed description when considered in connection with the accompanying drawings:

FIG. 9 is a table representing the probability of the rotation of a symbol;

FIG. 10 is a table representing the probability of the direction of rotation of a symbol;

FIG. 11 is a table representing the probability of the angle of rotation of a symbol;

FIG. 12 is a table representing the probability of paste positions for a symbol;

FIG. 13 is a table representing the re-draw paste probabilities for a symbol;

FIG. 14 is a table representing the initial activation reel probabilities for a 2 reel embodiment; and FIG. 15 is a table representing the initial activation reel probabilities for more than a 2 reel embodiment.

Corresponding reference characters indicate corresponding parts throughout the drawings.

DETAILED DESCRIPTION OF THE INVENTION

Figure 1:
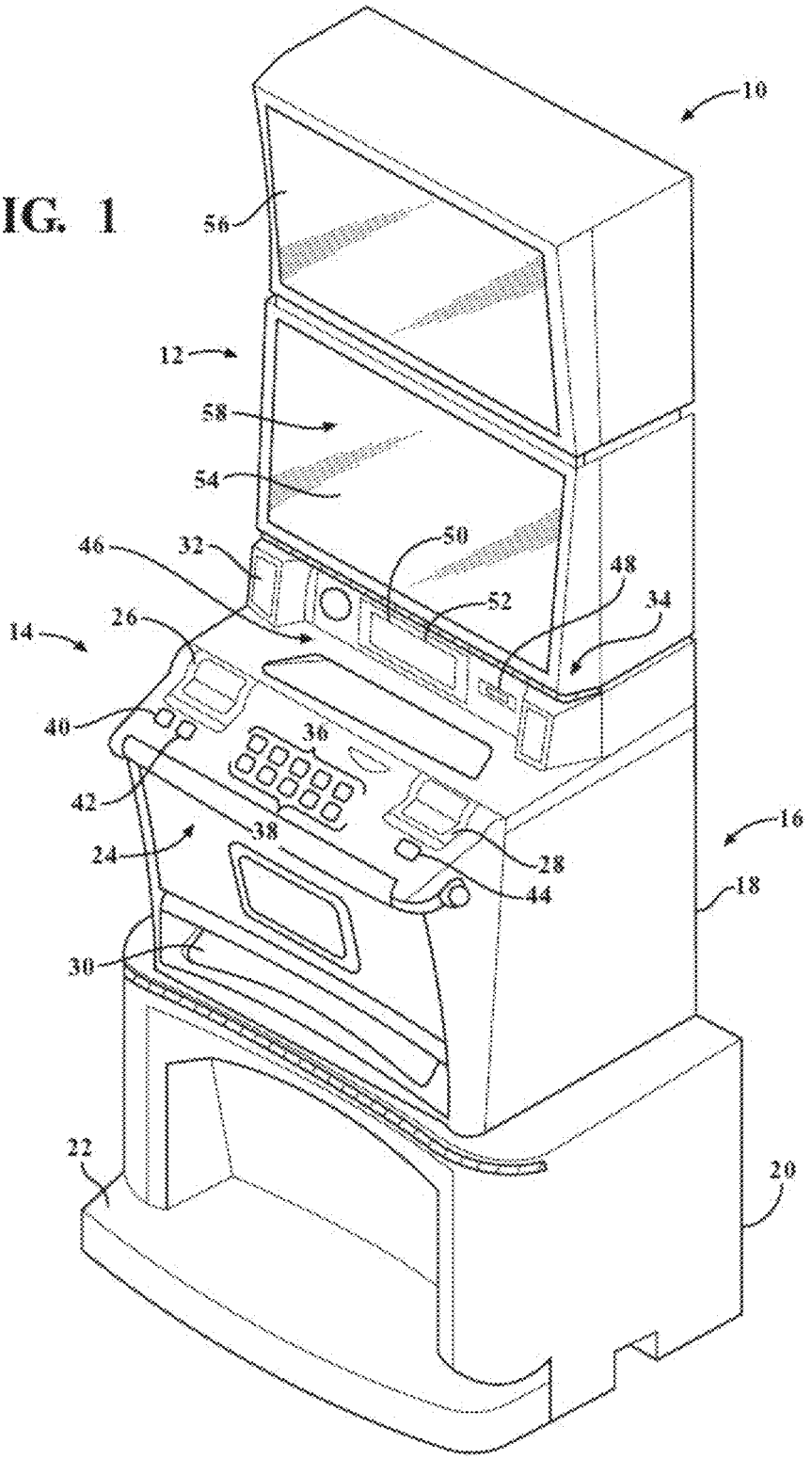
FIG. 1 is a perspective view of an exemplary gaming machine for use in the system of FIG. 1.

With reference to the drawings and in operation, the present invention overcomes at least some of the disadvantages of known gaming machines by providing a step-based and multiple-pattern game play sequence over the course of a game. More specifically, the gaming machine determines a series of intervals based on a predetermined game trigger. The game machine will then proceed to alter at least two separate sets of symbol patterns over the course of these intervals. These changes involve equal increases and decreases of gaming symbols and symbol types 88 and can alternatively involve overriding symbol positions or maintaining certain symbol positions over the course of the predetermined intervals. This creates a more interactive and randomized game experience, enhancing the player's expectation for achieving a win and the improving the enjoyment of the game. Thus, the amount of time that the game is played by patrons of a gaming establishment is increased.

In one embodiment, the gaming machine 10 allows a player to initiate a gaming session to play a plurality of video slot games via the gaming machine 10. The gaming machine 10 displays a game, accepts a wager on the game, generates a game outcome including a plurality of gaming symbols 88 at a plurality of symbol positions 112, and provides an award to the player if a winning combination is displayed in the generated game outcome. During play of the game, the gaming machine 10 detects a trigger condition and generates a number of game intervals in relation to that trigger. The intervals are then established on the game machine prior to continuing any game play on the game machine 10. Then, the machine determines the initial number of symbols or symbol types that are changed over the course of the intervals determined by the game machine 10. The game machine 10 then proceeds through the first interval using a pattern for each reel in play, utilizing at least two different patterns for all reels 98 currently in use. After the first interval, the gaming machine 10 will then change the amount of the gaming symbols or symbol types 88 within the reel 98 by increasing and/or decreasing certain symbols or symbol types 88 along the reels 98. The symbol position 112 held by the game symbol 88 may also be altered along the reel 98. The final patterns are then maintained after the final interval is finished and until the end of the particular segment of game play.

A selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Gaming Machine

Figure 2:
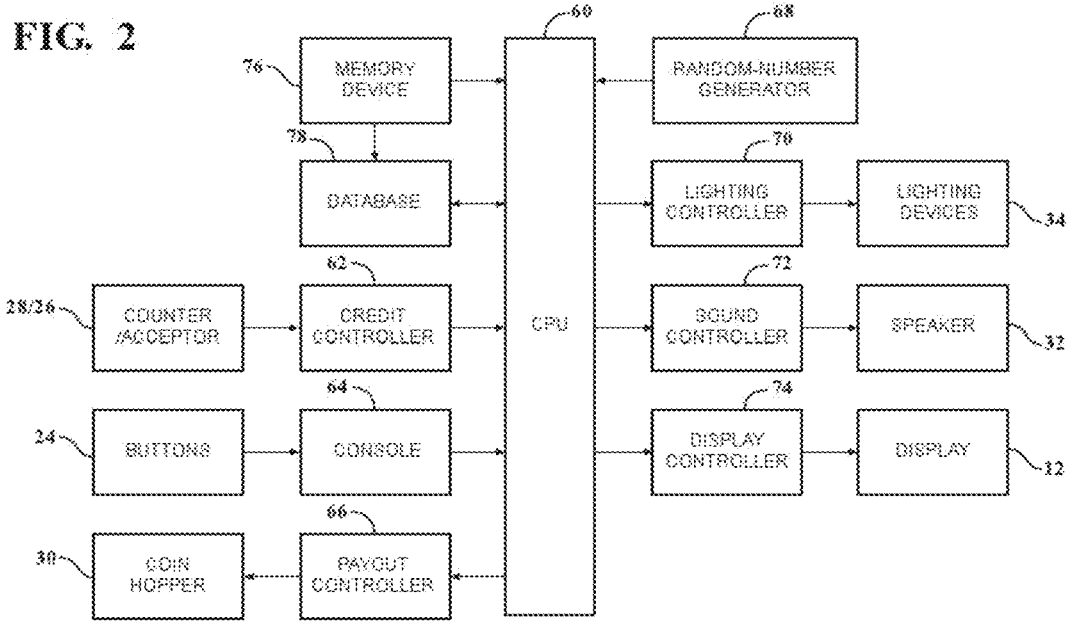
FIG. 2 is a schematic showing the structure of the gaming machine shown in FIG. 1.

FIG. 1 is a perspective view of an exemplary gaming machine 10. FIG. 2 is a schematic representation of the gaming machine 10. A preferred embodiment of the present invention is a video gaming machine preferably installed in a casino. In the illustrated embodiment, the gaming machine 10 includes a display device 12 for displaying a plurality of games, a user input device 14 to enable a player to interface with the gaming machine 10, and a gaming controller 16 that is operatively coupled to the display device 12 and the user input device 14 to enable a player to play games displayed on the display device 12. The gaming machine 10 also includes a cabinet assembly 18 that is configured to support the display device 12, the user input device 14, and/or the gaming controller 16 from a gaming stand 20 and/or a supporting surface 22.

The display device 12 and the user input device 14 are coupled to the cabinet assembly 18 and are accessible by the player. In one embodiment, the gaming controller 16 is positioned within the cabinet assembly 18. Alternatively, the gaming controller 16 may be separated from the cabinet assembly 18, and connected to components of the gaming machine 10 through a network such as, for example, a local area network (LAN), a wide area network (WAN), dial-in-connections, cable modems, wireless modems, and/or special high-speed Integrated Services Digital Network (ISDN) lines.

In one embodiment, the user input device 14 includes a plurality of input buttons 24, a coin slot 26, and/or a bill acceptor 28. The coin slot 26 includes an opening that is configured to receive coins and/or tokens deposited by the player into the gaming machine 10. The gaming machine 10 converts a value of the coins and/or tokens to a corresponding amount of gaming credits that are used by the player to wager on games played on the gaming machine 10.

The bill acceptor 28 includes an input and output device that is configured to accept a bill, a ticket, and/or a cash card into the bill acceptor 28 to enable an amount of gaming credits associated with a monetary value of the bills, ticket, and/or cash card to be credited to the gaming machine 10. Moreover, the gaming machine 10 may also utilize a cashless wagering system (not shown), such as a ticket in ticket out (TITO) system (not shown). In one embodiment, the bill acceptor 28 also includes a printer (not shown) that is configured to dispense a printed voucher ticket that includes information indicative of an amount of credits and/or money paid out to the player by the gaming machine 10 during a gaming session. The voucher ticket may be used at other gaming machines, or redeemed for cash, and/or other items as part of a casino cashless system (not shown).

A coin tray 30 is coupled to the cabinet assembly 18 and is configured to receive a plurality of coins that are dispensed from the gaming machine 10. One or more speakers 32 are installed inside the cabinet assembly 18 to generate voice announcements and/or sound effects associated with game play. The gaming machine 10 also includes one or more lighting devices 34 that are configured to blink and/or change brightness and color in specific patterns to produce lighting effects to enhance a visual gaming experience for the player.

In one embodiment, the input buttons 24 include a plurality of BET switches 36 for inputting a wager on a game, a plurality of selection switches 38 for selecting a betting line and/or card, a MAXBET switch 40 for inputting a maximum wager, a PAYOUT switch 42 for ending a gaming session and dispensing accumulated gaming credits to the player, and a start switch, i.e., a SPIN/DEAL button 44 to initiate an output of a game.

In the illustrated embodiment, the BET switches 36 include five switches from 1BET to 5BET to enable a player to wager between a minimum bet up to 5× minimum bet. Each selection switch 38 corresponds to a betting line such as, for example, a payline and/or symbol for a reel game, one or more cards for a card game, and/or a symbol for a roulette game, to enable a player to associate a wager with one or more betting lines. The MAXBET switch 40 enables a player to input the maximum bet that a player can spend against one time of a game. The PAYOUT switch 42 enables a player to receive the amount of money and/or credits awarded to the player during a gaming session, which has been credited onto the gaming machine 10.

The gaming machine 10 may also include a player tracking device 46 that is coupled to the gaming controller 16 for identifying the player and/or a player tracking account that is associated with the player. The player tracking account may include, but is not limited to, gaming credits available to the player for use in playing the gaming machine 10. The player tracking device 46 is configured to communicate player account information between a player tracking controller (not shown) and the gaming machine 10. For example, the player tracking device 46 may be used to track bonus points and/or credits awarded to the player during a gaming session and/or track bonus and/or credits downloaded to the gaming machine 10 from the player tracking system.

The player tracking device 46 is coupled to the gaming cabinet assembly 18 and includes a player identification card reader 48, a data display 50, and a keypad 52. The player identification card reader 48 is configured to accept a player tracking card (not shown) inserted by the player, and read information contained on the player tracking card to identify the player account information. The player identification card reader 48 may include, but is not limited to, a barcode reader, a magnetic card reader, and/or a radio frequency identification (RFID) card reader. The keypad 52 is configured to accept a user selection input such as, for example, a unique player personal identification number (PIN) to facilitate enabling the gaming machine 10 to identify the player, and access player account information associated with the identified player to be displayed on the data display 50. In one embodiment, the data display 50 includes a touchscreen panel that includes the keypad 52. Alternatively, the data display 50 and the keypad 52 may be included in the display device 12.

In one embodiment, the display device 12 includes a first display 54 and a second display 56. The first display 54 is configured to display a game screen 58 (shown in FIG. 3) including indicia and/or symbols for use in a game, e.g., cards used by a card game, roulette wheel and symbols used in a roulette game, and reels used in a reel game. The game screen 58 may include any type of game including, but not limited to, a video slot game, a keno game, a blackjack game, a video poker game, or any type of game which allows a player to make a wager, play a game, and potentially provide the player an award based on an outcome of the game and a paytable. The second display 56 is configured to display game play instructions for performing the game including, but not limited to, playing instructions, paytables, paylines, betting lines and/or any other information to enable the gaming machine 10 to function as described herein. Moreover, each display 54 and 56 may be configured to display at least a portion of the game screen 58 and/or game play instructions. In one embodiment, the first and second displays 54 and 56 each include a flat panel display, such as a cathode ray tube display (CRT), a liquid crystal display (LCD), a light-emitting diode display (LED), a plasma display, and/or any suitable visual output device capable of displaying graphical data and/or text to a user. Alternatively, a single component, such as a touch screen, may function as both the display device 12 and as the user input device 14. In an alternative embodiment, the first display 54 and/or the second display 56 includes a plurality of mechanical reels displaying a plurality of game symbols.

Referring to FIG. 2, in one embodiment, the gaming controller 16 includes a processor, i.e., a central processing unit (CPU) 60, a credit controller 62, a console unit 64, a payout controller 66, a random-number generator (RNG) 68, a lighting controller 70, a sound controller 72, a display controller 74, a memory device 76, and a database 78. Memory device 76 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the CPU 60 to store, retrieve, and/or execute instructions and/or data.

The CPU 60 executes various programs, and thereby controls other components of the gaming controller 16 according to player instructions and data accepted by the user input device 14. The CPU 60 in particular executes a game program, and thereby conducts a game in accordance with the embodiments described herein. The memory device 76 stores programs and databases used by the CPU 60. Moreover, the memory device 76 stores and retrieves information in the database 78 including, but not limited to, a game type, a number of reels associated with a game, a number of reel strips associated with each reel, a number of symbol positions being displayed on each reel strip, a type of symbols being displayed on each symbol position, a predefined set of normal symbols, a predefined set of special symbols, image data for producing game images and/or screens on the display device 12, and temporarily stores variables, parameters, and the like that are used by the CPU 60. In addition, the memory device 76 stores indicia, symbol weights, pay tables, and/or winning combination tables which represent relationships between combinations of random numbers and types of awards. In one embodiment, the memory device 76 utilizes RAM to temporarily store programs and data necessary for the progress of the game, and EPROM to store, in advance, programs and data for controlling basic operation of the gaming machine 10, such as the booting operation thereof.

The credit controller 62 manages the amount of player's credits, which is equivalent to the amount of coins and bills counted and validated by the bill acceptor 28. The console unit 64 is coupled to the user input device 14 to monitor player selections received through the input buttons 24, and accept various instructions and data that a player enters through the input buttons 24. The payout controller 66 converts a player's credits to coins, bills, or other monetary data by using the coin tray 30 and/or for use in dispensing a credit voucher via the bill acceptor 28.

The lighting controller 70 controls one or more lighting devices 34 to blink and/or change brightness and color in specific patterns in order to produce lighting effects associated with game play. The sound controller 72 controls the speakers 32 to output voice announcements and sound effects during game play. The display controller 74 controls the display device 12 to display various images on screens preferably by using computer graphics and image data stored in the memory device 76. More specifically, the display controller 74 controls video reels in a game screen displayed on the first display 54 and/or the second display 56 by using computer graphics and the image data.

The RNG 68 generates and outputs random numbers to the CPU 60 preferably at the start of each round of game. The CPU 60 uses the random numbers to determine an outcome of a game. For example, if the game is a video slot game, the CPU 60 uses the RNG 68 to randomly select an arrangement of symbols to be displayed on video reels. Moreover, the CPU 60 generally uses random numbers generated by the RNG 68 to play the games, and to determine whether or not to provide an award to a player. In addition, the CPU 60 generates game outcomes including combinations of random numbers, and compares the generated combinations with winning combinations stored in the winning combination table to determine if the generated outcome is a winning outcome that is associated with a type of award.

Figure 3:
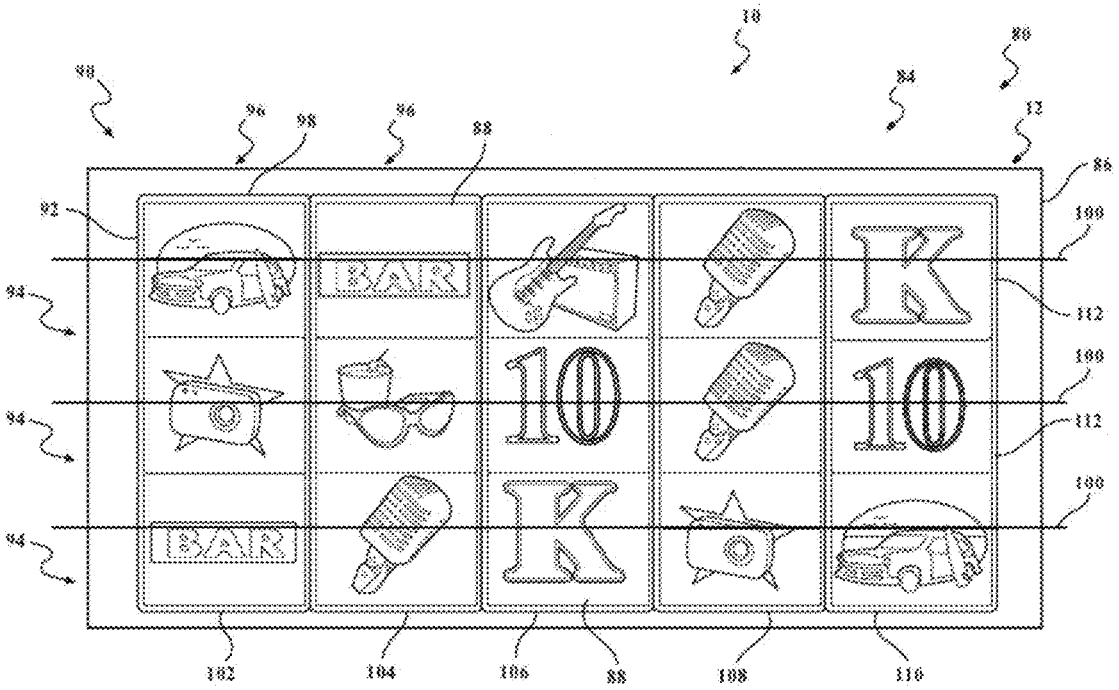
FIG. 3 is a graphical display of a video slot game including a plurality of reels, according to an embodiment of the present invention.
Figure 4:
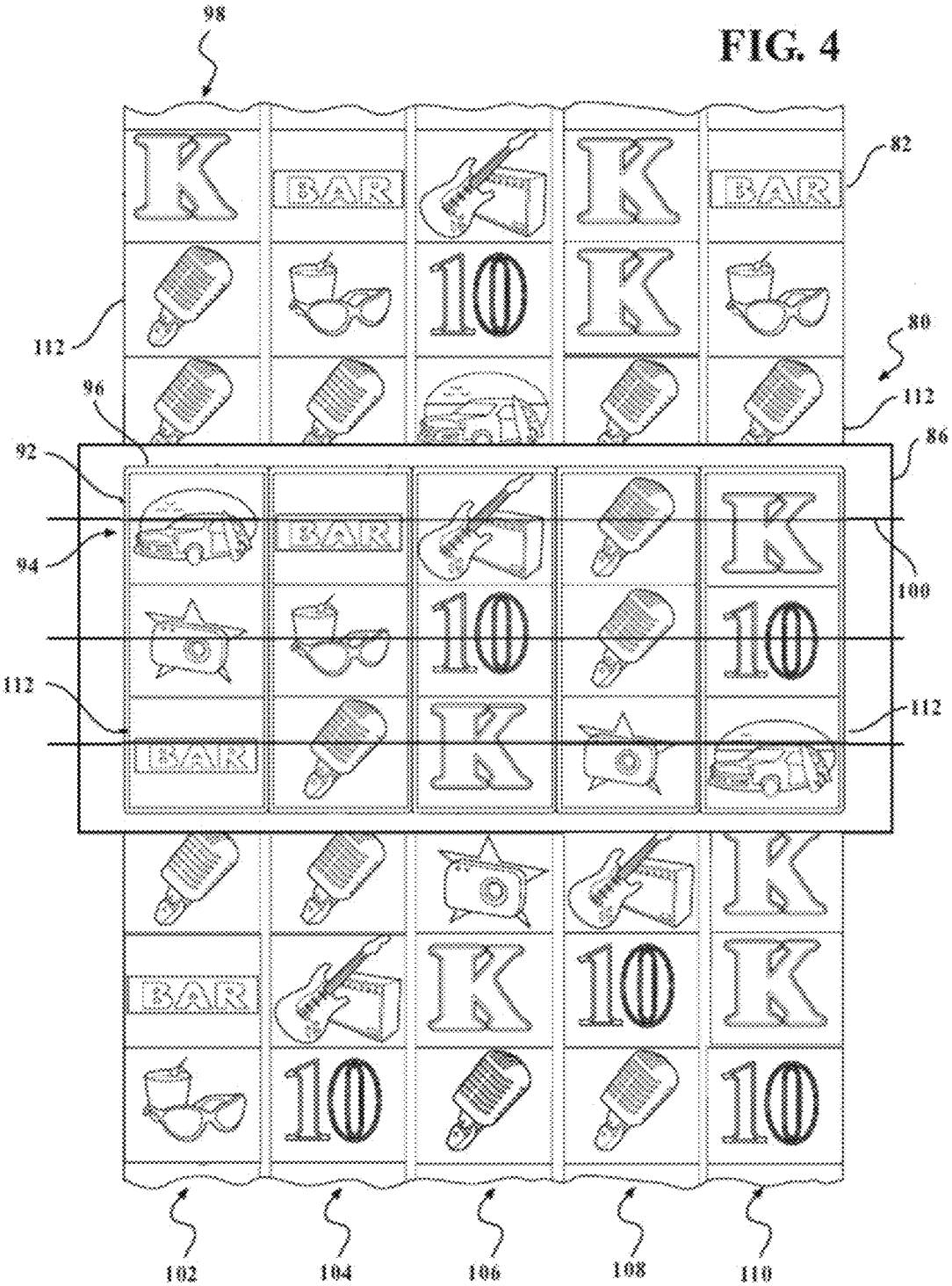
FIG. 4 is a schematic representation of a plurality of reel strips that may be used with at least one slot reel of the video slot game of FIGS. 3 and 4, according to an embodiment of the present invention.

FIG. 3 is an exemplary graphical display of a game 80 that is displayed by the gaming machine 10 shown in FIG. 1. FIG. 4 is a schematic representation of a portion of the gaming machine 10 including the game 80. In the illustrated embodiment, the gaming controller 16 is configured to display the game 80 on the display device 12. In one embodiment, the game 80 is a video slot game. However, it should be noted that the game 80 may be any type of game upon which a player could make a wager including, but not limited to a keno game, a blackjack game, a video poker game, or any type of game that enables the gaming machine 10 to function as described herein. In the illustrated embodiment, the game 80 is displayed on the first display 54. Alternatively, the game 80 may be displayed on the first display 54 and/or the second display 56.

In general, during play of the main game 80, the gaming controller 16 randomly generates an outcome 84 of the main game 80 and displays the generated game outcome 84 in a display area 86. The gaming controller 16 randomly selects a plurality of game symbols 88 from a predefined set of possible game symbols and displays the selected game symbols 88 associated with the generated game outcome 84 in the game display area 86.

In the illustrated embodiment, the plurality of game symbols 88 are displayed in a grid 90 having a plurality of cells 92 arranged along a plurality of rows 94 and a plurality of columns 96. Each cell 92 displays one or more game symbols 88 associated with the game outcome 84. In the illustrated embodiment, the gaming controller 16 displays the game symbols 88 within a plurality of reels 98. Each reel 98 is associated with a corresponding column 96. The main game 80, in one embodiment, includes 5 reels 98 with 3 cells 92 displayed in the display area 86 per reel 98 (a "3×5" arrangement). Alternatively, other reel arrangements may be used such as, for example, 4, 5, 5, 5, and 4 cells per reel, respectively (a "4-5-5-5-4" arrangement), 3-4-3-4-3, or 4-5-4-5-4 arrangements or arrangements with the same number of cells per column, such as 3×3, 3×4, 45, or 5×5 configurations. The main game 80 also includes a plurality of paylines 100 that extend across one or more cells 92 to indicate, to the player, a combination of game symbols 88. In one embodiment, the gaming machine 10 displays the main game 80 via a plurality of mechanical reels (not shown) that include a plurality of symbols displayed on a circumferential surface of each reel.

Each slot game is generally played in a conventional manner. The player makes a wager, which may be based on a predetermined denomination and a selected number of paylines, the gaming controller 16 randomly generates an outcome for the game, spins the reels, and selectively stops the reels to display a game symbol 88 in each of the display cells 92. If a predetermined pattern of symbols 88 is randomly chosen for each cell 92 associated with a played payline 100, the player may be awarded a payout based on the payline, the wager, and a predetermined paytable. Moreover, the player may be awarded a payout if the combination of symbols associated with a selected payline is a winning combination. In addition, a player may receive a bonus feature and/or a bonus game based on the combination of symbols associated with the selected payline and/or the appearance of one or more predefined symbols in the game outcome 84. Many variations to the above described general play of a slot game fall within the scope of the present invention. Such slot games are well-known in the art, and are therefore not further discussed.

In the illustrated embodiment, the gaming machine 10 receives a signal, from the user input device 14, that is indicative of a player's selection to initiate a gaming session including a wager amount, and a selection of one or more paylines 100 associated with a predefined set of cells 92 within the displayed grid 90. In the illustrated embodiment, the gaming machine 10 is a multi-line game, i.e., the paylines include horizontal paylines and/or diagonal paylines, and/or zig-zag paylines. Moreover, the user input device 14 may allow the player to toggle to increase the bet per payline a credit at a time (up to the maximum bet). The gaming controller 16 randomly generates an outcome of the main game 80, and displays the generated outcome on the display device 12. In one embodiment, the gaming controller 16 is configured to rotate, and/or spin each reel 98 to initiate a game play, and stop each reel 98 to display a plurality of symbols 88 associated with the randomly generated outcome. In addition, the gaming controller 16 is adapted to determine if the generated outcome is a winning outcome based on the displayed game symbols 88, a pay-table, a wager, and one or more selected paylines 100. More specifically, the gaming machine 10 determines if a combination of symbols 88 arranged along the selected payline 100 is a winning combination. The gaming controller 16 may provide an award in response to the outcome of the main game 80. In general, the term "award" may be a payout, in terms of credits or money. Thus, gaming controller 16 may award a regular payout in response to the outcome of the main game 80. However, it should be noted that the term award may also refer to other types of awards, including, prizes, e.g., meals, show tickets, etc. . . . , as well as in-game awards, such as free games or awarding the player one or more wild symbols or stacked wild symbols in each of the games.

The gaming controller 16 is configured to display the game 80 including a plurality of reels 98. For example, in one embodiment, the gaming controller 16 displays the game 80 having five reels 98 orientated horizontally including a $1^{st}$ reel 102, a $2^{nd}$ reel 104, a $3^{rd}$ reel 106, a $4^{th}$ reel 108, and a $5^{th}$ reel 110. Each reel 98 may have a plurality of associated reel strips 82 that may be displayed on the respective reel 98. Each reel strip 82 includes a plurality of symbol positions 112. During display of the generated game outcome 84, the gaming controller 16 selects a reel strip 82 to be displayed on at least one of the reels 98, selects a plurality of game symbols 88 being displayed in each of the symbol positions 112 of each selected reel strip 82, and spins each reel 98 such that the game symbols 88 are moved through each of the cells 92 in the display area 86.

The illustrated embodiment can also include a bonus feature or secondary game in addition to the main game on the gaming machine. The bonus feature or secondary game is an add-on to the main game utilizing game symbol 88. A bonus feature or secondary game is considered an add-on to the main game that occurs during game play. The bonus feature or secondary game can use any in-game machine asset that is used to display an award related to the main game. Such awards include free spins, credits, a credit multiplier, or additional pseudo game-play unrelated to the main game. The bonus feature or secondary game can be in any of the wagering or non-wagering formats as described above (slots, video poker, etc.). A bonus feature or secondary game may also be similar to the main game through the use of additional random numbers in order to continue randomized, wager-based game play. A bonus feature or secondary game may include any additional game play and grant awards based on any particularized triggers built into the main game of the game machine. It should be noted that the game may only include the main game 80. Alternatively, the game may include the main game 80 and one or more bonus features and/or one or more secondary games. It should be noted that the present invention is not limited to any specific bonus feature or secondary game (or type thereof). Exemplary bonus features or secondary games are disclosed in U.S. Pat. No. 7,824,260, U.S. Pat. No. 8,052,515, U.S. Pat. No. 8,096,869, U.S. Pat. No. 8,303,397, and U.S. Patent Application Publication No. 2011/0223985, all of which are hereby incorporated by reference.

Figure 5:
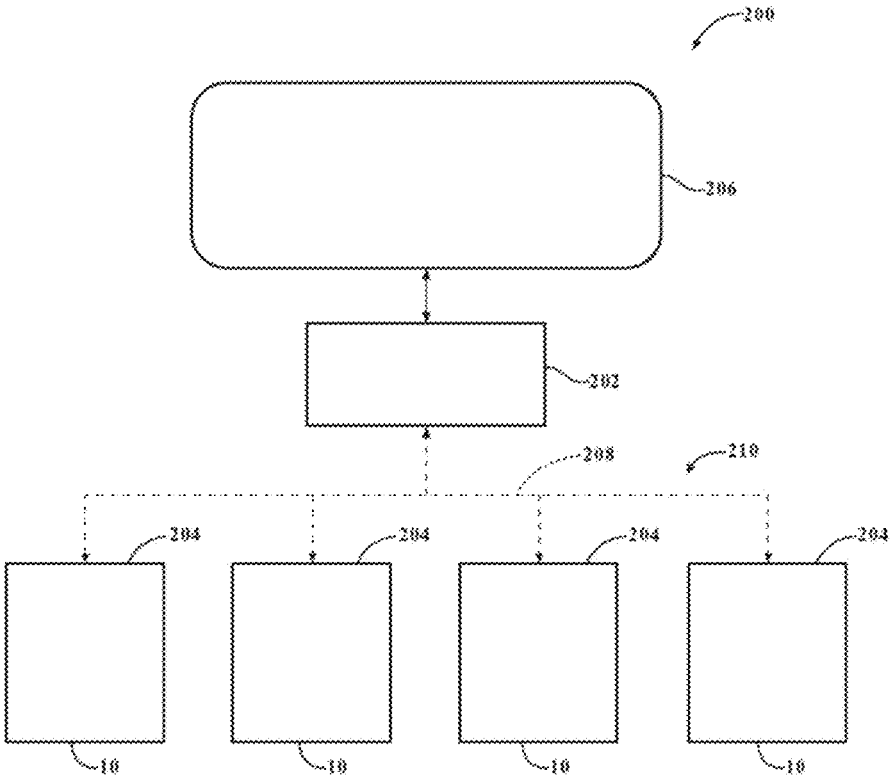
FIG. 5 is a schematic view of an exemplary gaming system of the present invention.

FIG. 5 is a schematic view of an exemplary gaming system 200. The gaming system 200 includes a system controller 202 and one or more gaming terminals 204 that are coupled to the system controller 202. The gaming system 200 may also include a central display 206 that is coupled to the system controller 202 for displaying games played on one or more of the gaming machines 10. In one embodiment, the gaming terminal 204 includes the gaming machine 10. In another embodiment, gaming terminal 204 may include a personal computer, laptop, cell phone, smartphone, tablet computer, personal data assistant, and/or any suitable computing device that enables a player to connect to system controller 202 to play the game 80.

In the illustrated embodiment, the gaming machines 10 and the system controller 202 are coupled in communication with a local area network (LAN) 208. Alternatively, the gaming machines 10 and the system controller 202 may be coupled via a network such as, for example, an Internet link, an intranet, a WAN, dial-in-connections, cable modems, wireless modems, and/or ISDN lines. In the illustrated embodiment, the gaming system 200 includes four gaming machines 10, which in one embodiment as shown in FIG. 9 are arranged in a bank 210, i.e., are arranged together, adjacently. It should be noted, however, that the gaming system 200 may include any number of gaming machines 10 that may be arranged in any manner, such as in a circle or along a curved arc, or positioned within separate areas of a casino floor, and/or separate gaming establishments such as different casinos. Furthermore, additional groups of gaming machines 10 may be coupled to the system controller 202. In one embodiment, the system controller 202 may be implemented by one of the gaming controllers 16 associated with a gaming machine 10. In still another embodiment, the system controller 202 may be located remotely with respect to gaming machines 10, or within one of the gaming machine cabinet assemblies 18 (shown in FIG. 1). The system controller 202 is configured to perform all of the functions of the gaming controller 16 as described herein.

In the illustrated embodiment, the system controller 202 determines if a triggering event occurs in a game outcome being played at one or more of the gaming machines 10, and displays a bonus game such as, for example, the game 80 on the central display 206 if the triggering event occurs. Alternatively, the system controller 202 may display the game 80 at one or more gaming machines 10 based on one or more triggering events occurring in games played at the gaming machines 10. The triggering event may be the appearance of a predefined symbol and/or a predefined symbol combination in a game outcome.

Figure 8:
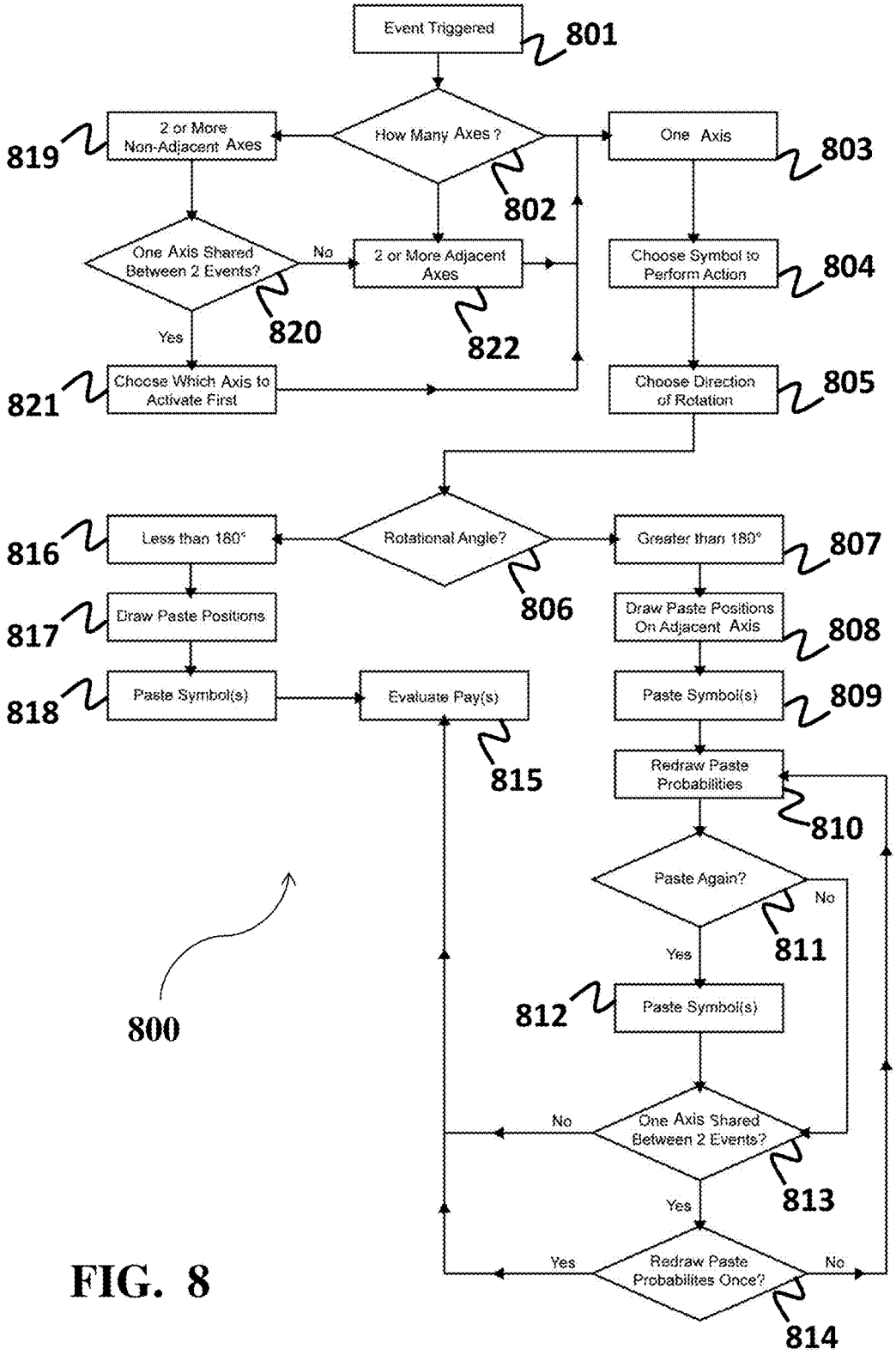
FIG. 8 is a flowchart of an exemplary method of allowing a player to play a gaming machine, according to an embodiment of the present invention.

Referring to FIGS. 8 and 4, during play of the game 80, the system controller 202 determines a number of game outcomes, i.e., free spins that will be displayed based at least in part on the triggering event. The system controller 202 displays, for each bonus game 80, at least one reel 98 having a plurality of reel strips 82.

Rotating Symbol and Column Replication

In one aspect of the aspect of the present invention, the game machine 10 comprises a display device 12 and a gaming controller 16. The display device 12 is configured to display a plurality of symbol positions 112 displayed in a grid 90. The gaming controller 16 is configured to: initiate a game 80 and define an initial result. The initial result may include a game symbol 88 in each of the symbol positions 112 within the grid 90. The game controller 16 then detects a trigger condition. In one embodiment, the trigger condition is a collection of the same symbol 88 within every symbol position 112 of the grid 90 along a first axis. The first axis may be at least any one of the rows 94 or columns 96 within the grid 90. For the purposes of explanation the term axis will be used interchangeably with either one of the at least one row or column. The game controller 16 then determines at least one adjacent axis from the first axis as a function of predetermined criteria. The term "adjacent axis" shall be used to define any of the at least one adjacent symbol positions 112 where a game symbol may be copied due to rotation of the first axis about a symbol position 112 or pivot point 114 (see below). The predetermined criteria may include the selection of a symbol position 112 as a rotation point, the selection of a potential pivot point 114 as a rotation point, the number of symbol positions 112 used as the first axis, the number of trigger events involved, the adjacency of the first axes detected on the grid 90, and the rotational angle selected. The game controller 16 then copies the same game symbol 88 into at least one predetermined symbol position along the adjacent axis.

In another aspect of the present invention, the game symbols 88 within the grid 90 are selected from a subset of available symbols. This subset of available symbols may be all symbols available to the gaming controller 16 during a main game or a subset. This allows for variability within the gameplay presented.

In another aspect of the present invention, the first axis is at least one of the columns 96 present within the grid 90. The first axis may also include additional columns 96 on either the left or the right side of the at least one column 96 within the grid 90. Representations of possible column-based first axes are presented within FIG. 6*b*.

In another aspect of the present invention, the first axis is at least one of the rows 94 present within the grid 90. The first axis may also include additional rows either above or below the at least one row 94 within the grid 90. Representations of possible row-based first axes are presented within FIG. 6*c*.

Figure 6A:
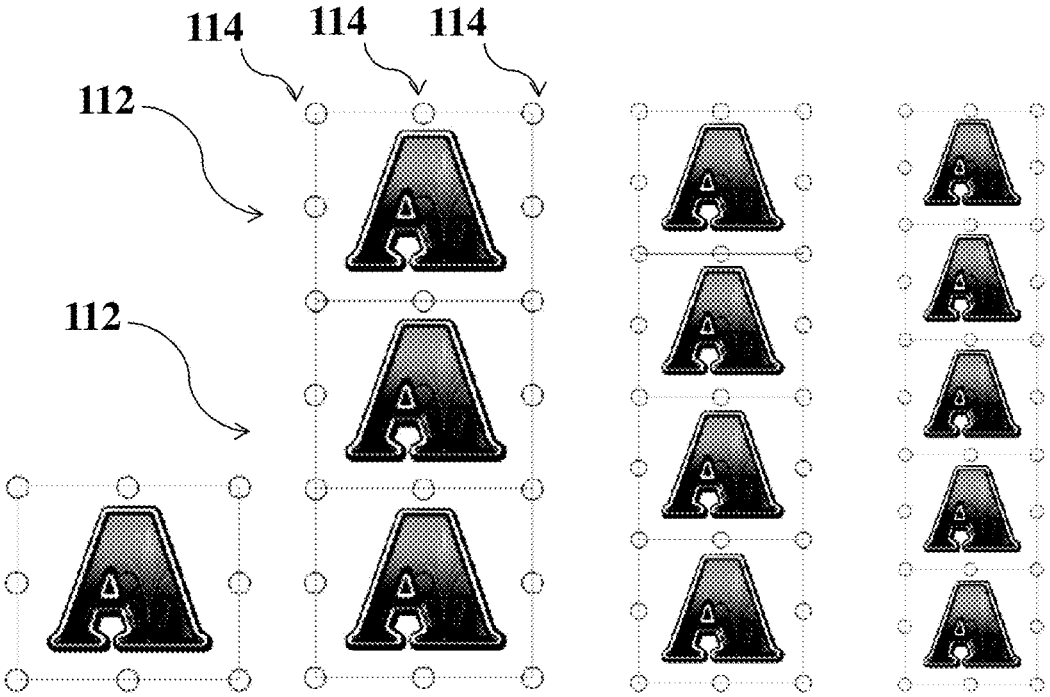
FIG. 6*a* is a drawing of multiple pivot point distributions based on various symbols in adjacent positions.
Figure 6B:
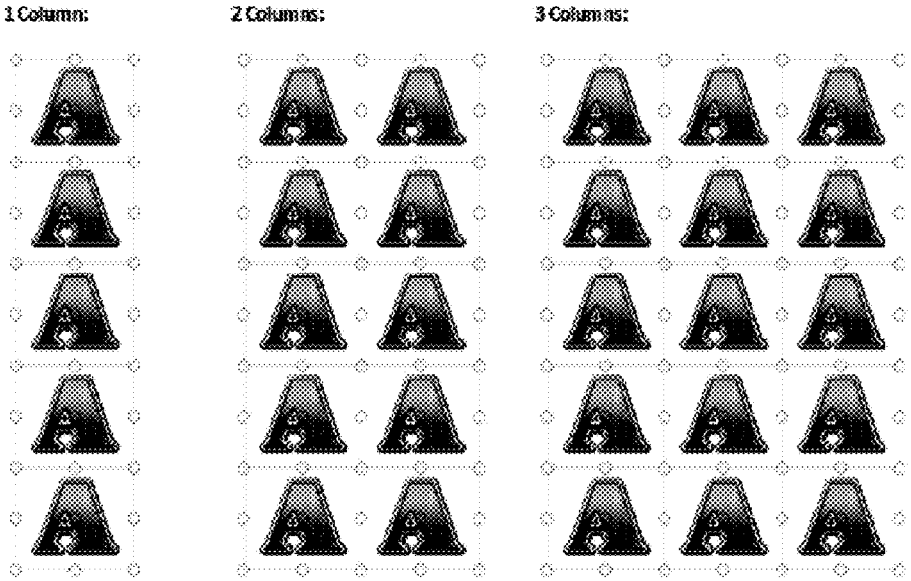
FIG. 6*b* is a drawing of multiple pivot point distributions based on various symbols in adjacent columns.
Figure 6C:
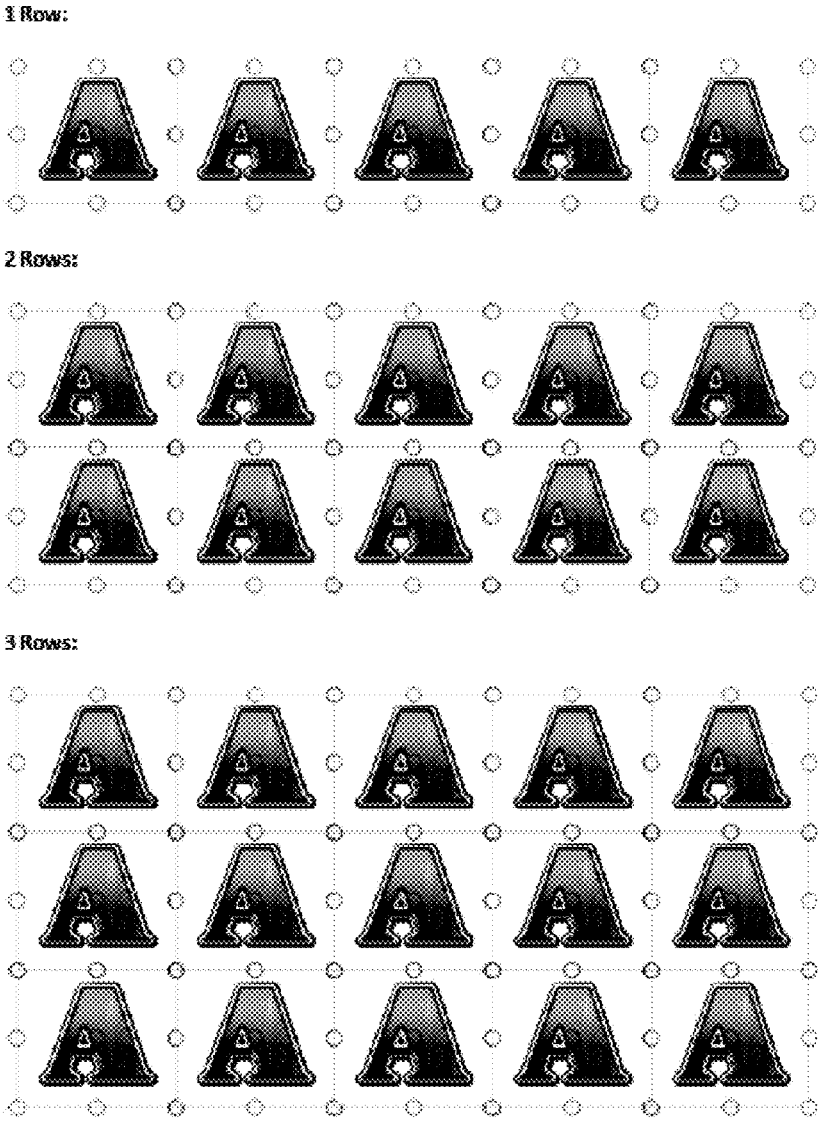
FIG. 6*c* is a drawing of multiple pivot point distributions based on various symbols in adjacent rows.

In another embodiment of the present invention, at least one of the symbol positions 112 along the first axis further includes a pivot point 114. A pivot point 114 is defined as any point within the game 80 that is associated with a symbol position 112 or symbol 88 and allows for the potential replication of additional symbols resulting from the rotation of the first axis about the pivot point. Only one potential pivot point 114 at a time may be used in order to rotate the first axis around the grid 90. FIGS. 6*a*, 6*b*, and 6*c* show representations of game symbols and their potential pivot point layouts, which may be altered in order to change the rotation of the first axis within the game.

FIGS. 6*a*, 6*b*, and 6*c* show several embodiments of symbol positions 112 as utilized within the game 80 that include a plurality of potential pivot points 114. As shown, each symbol position 112 may have nine different potential pivot points, with as many as eight of the pivot points 114 potentially shared with adjacent symbol positions 112 within the grid 90. The number of potential pivot points 114 associated with each symbol position 112 may be more or less depending on the particular game mechanics of the game 80. FIG. 6*b* and FIG. 6*c* show various embodiments of game symbols 88 within symbol positions 112 that demonstrate how multiple rows 94 or columns 96 would share common potential pivot points 114. As the number of symbols/columns/rows increases, the number of potential pivot point available increases accordingly. The number and position of the potential pivot points on a given game symbol 88 may be altered in order to vary the game mechanics, either prior to or during game play.

In another aspect of the present invention, the number of potential pivot points 114 may also vary according to the particular game symbol 88 present during the trigger event of the game. Different game symbols 88 may have a varying number of potential pivot points 114, changing the variability of the rotation of the symbols once the trigger event is registered.

In another aspect of the present invention, the gaming controller 16 is further configured to determine at least one adjacent axis from the first axis as a function of the at least one potential pivot point 114. Here, the gaming controller 16 may determine an adjacent axis in order to copy the same game symbol 88 into at least one predetermined symbol position 112 along the adjacent axis within the grid 90. Which potential pivot point is use will alter the rotation as seen by the player. Several embodiments address the axis of rotation as occurring along a z-axis from the potential pivot point 114 utilized after the trigger event is determined. For the purposes of this application the z-axis shall be an axis that is perpendicular to the display area 86 and emanating from a potential pivot point 114 towards the player playing the game. Rotational axes may also be from any potential pivot point on a game symbol 88 or plurality of symbols 88 along any x/y/z plane relative to the display area 86.

In another aspect of the present invention, the grid 90 further includes a plurality of additional symbol positions 112 and the gaming controller 16 is further configured to extend the grid 90 with at least one additional symbol position 112 prior to copying the same game symbol 88 into the at least one predetermined symbol position 112 along the adjacent axis. This extends the rotation of symbols outside of the standard game play grid.

Figure 7:
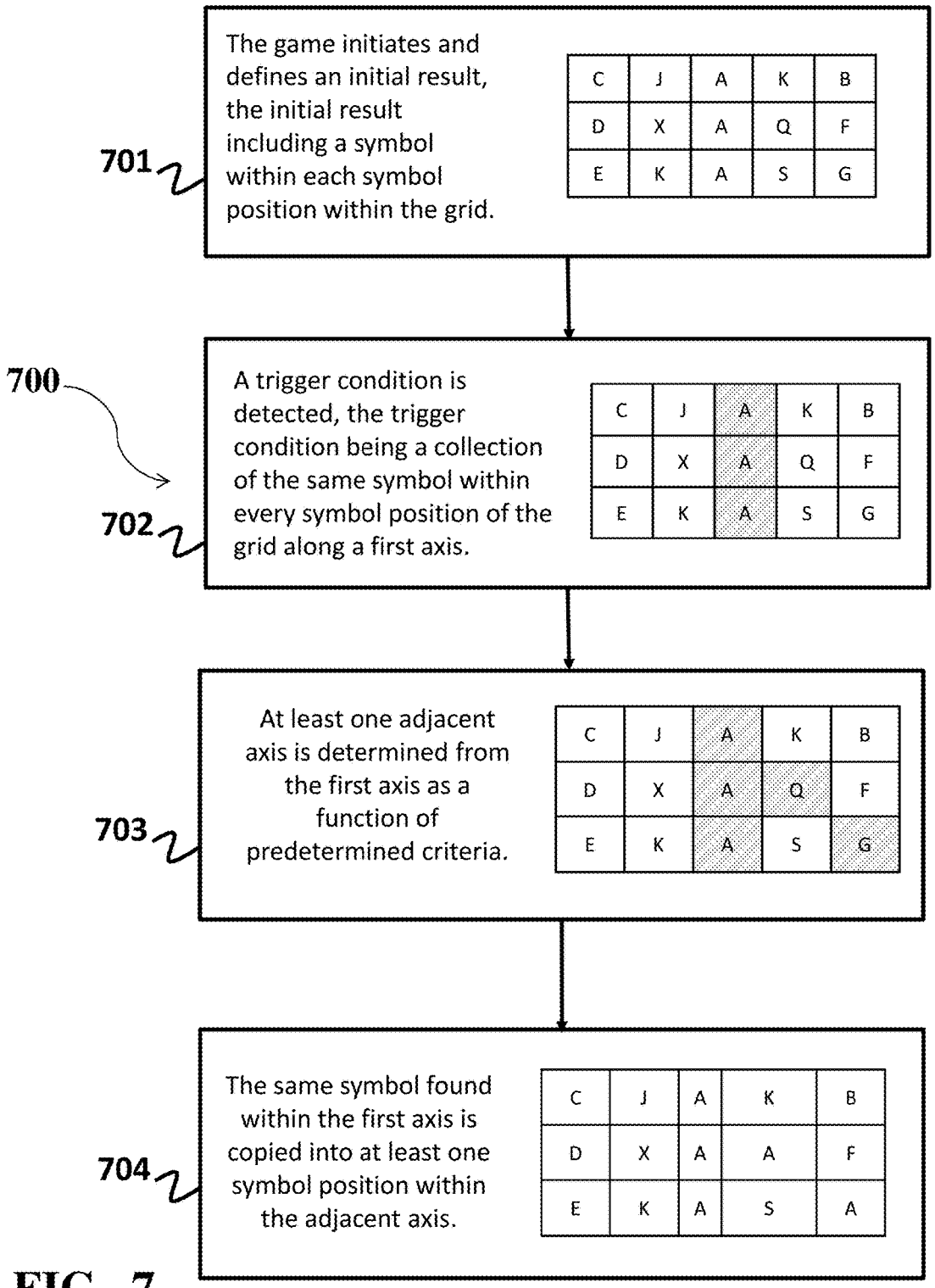
FIG. 7 is a flowchart of an exemplary method of allowing a player to play a gaming machine, according to an embodiment of the present invention.

In another aspect of the present invention, represented within FIG. 7, a method 700 of implementing a game machine 10 is provided. The method includes a display device 12 and a gaming controller 10. The display device 12 is configured to display a plurality of symbol positions 112 displayed in a grid 90. The method 700 includes the first step of initiating a game 80 and defining an initial result. The initial result may include a game symbol 88 in each of the symbol positions 112 within the grid 90. The method 700 then includes the step of detecting a trigger condition. In one embodiment, the trigger condition is a collection of the same symbol 88 within every symbol position 112 of the grid 90 along a first axis. The first axis may again be any row 94 or column 96 within the grid 90. The method 700 then determines at least one adjacent axis from the first axis as a function of predetermined criteria. The predetermined criteria may include the selection of a symbol position 112 as a rotation point, the selection of a potential pivot point 114 as a rotation point, the number of symbol positions 112 used as the first axis, the number of trigger events involved, the adjacency of the first axes detected on the grid 90, and the rotational angle selected. The method 700 then copies the same symbol 88 into at least one predetermined symbol position 112 along the adjacent axis.

Further referring to FIG. 7, the method 700 including rotating symbols 88 during game play is illustrated. The method begins at step 701, where the game machine 10 initiates a game 80 and defines an initial result, the initial result including a symbol 88 in each of the symbol positions 112 within the grid 90. From symbol 88 landing in every symbol position within grid 90, the game machine can proceed onto step 702 and detect the necessary trigger condition. Note that in other embodiments of the present invention, the initial result can also be determined on a column-by-column or row-by-row basis depending on the desired trigger condition detected within step 702.

Next, at step 702, a trigger condition is detected, the trigger condition being a collection of the same symbol 88 within every symbol position 112 of the grid 90 along a first axis. Such a first axis may be a column 96 or a row 94 depending on the game mechanics of the game 80. The trigger condition may be detected within the game machine 10 (through the gaming controller 16) or by the system controller 202.

Then, at step 703, the game machine determines at least one adjacent axis from the first axis as a function of predetermined criteria. The predetermined criteria may include the selection of a symbol position 112 as a rotation point, the selection of a potential pivot point 114 as a rotation point, the number of symbol positions 112 used as the first axis, the number of trigger events involved, the adjacency of the first axes detected on the grid 90, and the rotational angle selected.

Finally, at step 704, the game machine copies the same symbol 88 into at least one predetermined symbol position 112 along the adjacent axis within the grid 90. The successive copying of the same symbol 88 into additional adjacent symbol positions 112 along an axis in turn determines the rotating effect generated within this method.

In another aspect of the present invention, the method 700 further includes the step of selecting the symbols 88 within the grid from a subset of available symbols. The subset of available symbols may be all symbols available to the gaming controller 16 during a main game or a special subset that is only accessible for the rotation and replication of symbols.

In another aspect of the present invention, at least one of the symbol positions 112 along the first axis further includes a pivot point 114 and the method 700 further includes determining the at least one adjacent axis from the first axis as a function of the at least one pivot point 114. Then, the method 700 includes copying the same symbol 88 into at least one predetermined symbol position 112 along the adjacent axis within the grid 90. The location of the potential pivot points 114 as well the number of first axes detected by the trigger condition will effect the copying of the symbols into the adjacent axis.

In another aspect of the present invention, the grid 90 further includes a plurality of additional symbol positions 112 and further including the step of extending the grid 90 with at least one additional symbol 88 prior to copying the same symbol into the at least one predetermined symbol position 112 along the adjacent axis. The extension of the grid 90 will allow for visualization of axis rotation that extends outside of the grid 90 but can still be represented within the display area 86.

In another aspect of the present invention, a non-transitory information recording medium containing a computer readable program that functions as a game machine is provided. The game machine 10 comprises a display device 12 and a gaming controller 16. The display device 12 is configured to display a plurality of symbol positions 112 displayed in a grid 90. The gaming controller 16 is configured to: initiate a game 80 and define an initial result. The initial result may include a game symbol 88 in each of the symbol positions 112 within the grid 90. The game controller 16 then detects a trigger condition. In one embodiment, the trigger condition is a collection of the same symbol 88 within every symbol position 112 of the grid 90 along a first axis. The first axis may be at least any one of the rows 94 or columns 96 within the grid 90. The game controller 16 then determines at least one adjacent axis from the first axis as a function of predetermined criteria. The predetermined criteria may include the selection of a symbol position 112 as a rotation point, the selection of a potential pivot point 114 as a rotation point, the number of symbol positions 112 used as the first axis, the number of trigger events involved, the adjacency of the first axes detected on the grid 90, and the rotational angle selected. The game controller 16 then copies the same game symbol 88 into at least one predetermined symbol position along the adjacent axis.

In another aspect of the present invention, referenced in FIG. 8, the method 800 of rotating symbols 88 during game play is illustrated. The method begins at step 801, where an event during a game played on a game machine 10 triggers the method 800 in order to begin the rotating symbols process. This event may be the presence of an identical symbol within every symbol position 112 along a row 94 or a column 96 (herein identified as an axis). It should be noted that while a single axis may be a predetermined trigger event, the presence of multiple axes may also trigger the start of method 800 at step 801.

Next, at step 802, the gaming controller 16 determines the number of first axes involved in the method 800 after the triggering event has occurred. If multiple first axes are detected the method 800 continues through determining the adjacency of these first axes prior to activating the remainder of the method 800 (discussed further below).

Next, at step 803, the method 800 continues with one axis used as the trigger event for the purposes of explanation. At step 804, the game controller 16 chooses a game symbol 88 as the center of rotation of the symbols within the first axis. FIG. 9 is a table representing the predetermined probabilities for which symbol would be selected as the center of the rotation for an illustrative 3-symbol high column having a top, middle, and bottom symbol. Here, each symbol within the 3-symbol high column has an equal weight and/or probability. These probabilities can be shifted in order to alter the visual and gaming dynamics of the game. Furthermore, this table may also be expanded to account for each of the potential pivot points 114 found within the first axis, granting a predetermined probability to each pivot point or points that may be used as the center of rotation. This table may also be expanded to account for all pivot points founds within multiple adjacent axes in order to have them rotate together.

Next, at step 805, the game controller 16 chooses a direction of rotation for the game symbols 88 in the first axis. FIG. 10 is a table representing the predetermined weights and/or probabilities given to both clockwise and counter-clockwise directions of rotation. Additional directions, along with their probabilities, may be added depending on the visualization of the rotation (i.e. whether the rotation is centered on the x/y/ or z axis).

Next, at step 806, the game controller 16 chooses an angle of rotation for the first axis of game symbols 88 within the grid 90. FIG. 11 is a table representing the predetermined weights or probabilities given to all available angles of rotation. Additional angles and their probabilities may be added according to the game dynamics needed.

After step 806, the process splits into two different paths. One path involves using a rotational angle greater than 180 degrees while the other path involves a rotational angle less than 180 degrees.

For all rotational angles greater than 180 degrees, the method continues on to steps 807 and 808, where the game controller 16 draws and determines pasted positions for adjacent axes within the grid. FIG. 12 is a table representing the available paste positions and their predetermined weights and probabilities. Additional weights and probabilities may be added according to the game dynamics needed. For example, additional weights and probabilities may be added in order to account for the additional symbol position outside of grid 90.

At step 809, the game controller 16 pastes the symbols within the first axis into the adjacent column(s) based on the selection made from the table in step 808.

Next, at step 810, the game controller then determines the possibility of a re-draw paste for each game symbol within the axis according to a re-draw paste table. FIG. 13 is a table representing the relatives re-draw paste probabilities for the game symbols within the axis. Again, the probabilities are predetermined and may be altered according to the game dynamics needed.

At step 811, the system 10 determines if the game symbols are pasted again based on the results from the table in FIG. 13. This table represents the independent probabilities for each position on the axis affected by the event. This draw only happens if the Paste Positions Draw did not result in a pasting event occurring in that position. If yes, then the game symbols are re-pasted into the adjacent grid cells at step 812. If not then the process determines if the current axis that is rotated is shared between two or more trigger events at step 813. If not, then the game machine 10 then evaluates the pays currently present on the grid 90 at step 815.

If the axis that is rotated is shared between two or more events, then the game controller 16 will cycle thru re-draw paste probabilities and repeat the entire procedure between steps 810 thru 814. Once all events are accounted for then the game machine 10 proceeds to evaluate the pays at step 815.

Returning back to step 806, the game controller proceeds through an alternate process (starting at step 816) if the rotational angle chosen is less than 180 degrees. This is due to the re-draw probabilities table (FIG. 13) not being required. The process draws the adjacent paste positions at step 817, pastes the adjacent symbols at step 818, and then proceeds to evaluate the pays on the grid 90 at step 815.

The process can also account for multiple first axes being used during the rotation process and may determine the order of activation accordingly. Stemming from step 802, the game controller 16 determines if two or more non-adjacent axes are involved in the rotation process at step 819. The, the game controller determines if the non-adjacent axis is shared between two separate trigger events. Since it is possible for non-adjacent axes to rotate independently, the game controller then proceeds to determine which axis may be activated first at step 821. Finally, if the axes are not split between independent events then the game controller 16 determines whether or not the axes are adjacent to each other at step 822. Adjacent axes may be fused into one first axis and rotate around one symbol position 112 or potential pivot point 114. The method 800 then proceeds onto step 803 in order to continue.

General Considerations

Exemplary embodiments of a gaming machine, a gaming system, and a method of allowing a player to play a gaming machine are described above in detail. The gaming machine, system, and method are not limited to the specific embodiments described herein, but rather, components of the gaming machine and/or system and/or steps of the method may be utilized independently and separately from other components and/or steps described herein. For example, the gaming machine may also be used in combination with other gaming systems and methods, and is not limited to practice with only the gaming machine as described herein. Rather, an exemplary embodiment can be implemented and utilized in connection with many other gaming system applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A game machine, comprising:

a display configured to display a plurality of symbol positions displayed in a grid including a plurality of rows and a plurality of columns;

a bill acceptor configured to establish a credit balance associated with a monetary value;

a user input device configured to enable a player to enter a wager that reduces the credit balance;

a cashout device configured to receive an input to cause an initiation of a payout associated with the credit balance; and a controller, the controller configured to:

initiate a game in response to the entered wager;

define an initial result for the game, the initial result including a symbol in each of the symbol positions within the grid;

detect a trigger condition, the trigger condition being defined as each symbol position orientated along a first axis defined along a column of the grid displaying the same symbol;

generate at least one adjacent axis upon detecting the trigger condition including:

selecting a symbol position from the symbols positions orientated along the first axis as a rotation point;

randomly determining a rotational direction as one of clockwise rotational direction and a counter clockwise rotational direction;

randomly selecting a rotation angle from a list of rotation angles, the list of rotation angles including at least one rotation angle that is not evenly divisible by 90 degrees;

determining an orientation of the at least one adjacent axis by rotating the at least one adjacent axis from the first axis about the selected rotation point in the determined rotational direction by the selected rotation angle;

determining a number of symbol positions included in the at least one adjacent axis based on a number of symbols positions included in the first axis; and for each of the determined number of symbol positions orientated along the at least one adjacent axis, randomly determining whether to copy the same symbol into a corresponding symbol position as a function of a paste position probability associated with the corresponding symbol position;

determine an outcome of the game based on the initial result and the copied symbols displayed in the grid; and upon receipt of the input from the cashout device, initiate a cashout of the credit balance based on the game outcome.

2. The game machine, as in claim 1, wherein the controller is further configured to:

determine if the selected rotational angle is greater than 180 degrees and responsively determine whether to initiate a re-draw paste for each game symbol within the at least one adjacent axis according to a re-draw paste table.

3. The game machine, as in claim 1, wherein the controller is configured to generate a first adjacent axis and a second adjacent axis upon detecting the trigger condition and randomly determine whether to copy the same symbol into each symbol position orientated along the first adjacent axis and the second adjacent axis.

4. The game machine, as in claim 3, wherein the first adjacent axis includes a different rotation angle than the second adjacent axis.

5. The game machine, as in claim 1, wherein the controller is configured to randomly select the symbol position from the symbols positions orientated along the first axis as the rotation point.

6. The game machine, as in claim 5, wherein each symbol position orientated along the first axis includes a selection probability associated with the rotation point.

7. The game machine, as in claim 1, wherein at least one of the symbol positions along the first axis further includes a pivot point, the controller further configured to:

determine the at least one adjacent axis from the first axis as a function of the at least one pivot point; and copy the same symbol into at least one predetermined position along the adjacent axis.

8. The game machine, as in claim 1, the grid further including a plurality of additional symbol positions and the controller further configured to extend the grid with at least one additional symbol position prior to copying the same symbol into the at least one additional symbol position along the adjacent axis.

9. A method of implementing a game on a game machine including a display configured to display a plurality of symbol positions displayed in a grid and a controller, the grid including a plurality of rows and a plurality of columns, the method including the steps of:

establishing a credit balance associated with a monetary value using a bill acceptor;

enabling a player to enter a wager using a user input device and reducing the credit balance by the wager;

initiating a game in response to the entered wager;

defining an initial result for the game, the initial result including a symbol in each of the symbol positions within the grid;

detecting a trigger condition, the trigger condition being defined as each symbol position orientated along a first axis defined along a column of the grid displaying the same symbol;

generating at least one adjacent axis upon detecting the trigger condition including:

selecting a symbol position from the symbols positions orientated along the first axis as a rotation point;

randomly determining a rotational direction as one of clockwise rotational direction and a counter clockwise rotational direction;

randomly selecting a rotation angle from a list of rotation angles, the list of rotation angles including at least one rotation angle that is not evenly divisible by 90 degrees;

determining an orientation of the at least one adjacent axis by rotating the at least one adjacent axis from the first axis about the selected rotation point in the determined rotational direction by the selected rotation angle;

determining a number of symbol positions included in the at least one adjacent axis based on a number of symbols positions included in the first axis; and for each of the determined number of symbol positions orientated along the at least one adjacent axis, randomly determining whether to copy the same symbol into a corresponding symbol position as a function of a paste position probability associated with the corresponding symbol position;

receiving an input by a cashout device to initiate a payout of the credit balance;

determining an outcome of the game based on the initial result and the copied symbols displayed in the grid; and upon receipt of the input from the cashout device, initiating a cashout of the credit balance based on the game outcome.

10. The method, as in claim 9, further including the step of determining if the selected rotational angle is greater than 180 degrees and responsively determining whether to initiate a re-draw paste for each game symbol within the at least one adjacent axis according to a re-draw paste table.

11. The method, as in claim 9, further including the steps of generating a first adjacent axis and a second adjacent axis upon detecting the trigger condition and randomly determining whether to copy the same symbol into each symbol position orientated along the first adjacent axis and the second adjacent axis.

12. The method, as in claim 11, wherein the first adjacent axis includes a different rotation angle than the second adjacent axis.

13. The method, as in claim 9, wherein including the step of randomly selecting the symbol position from the symbols positions orientated along the first axis as the rotation point.

14. The method, as in claim 13, wherein each symbol position orientated along the first axis includes a selection probability associated with the rotation point.

15. The method, as in claim 9, wherein at least one of the symbol positions along the first axis further includes a pivot point, the method further including the steps of:

determining the at least one adjacent axis from the first axis as a function of the at least one pivot point; and copying the same symbol into at least one predetermined position along the adjacent axis.

16. The method, as in claim 9, the grid further including a plurality of additional symbol positions and further including the step of extending the grid with at least one additional symbol position prior to copying the same symbol into the at least one additional symbol position along the adjacent axis.

17. A non-transitory information recording medium containing a computer readable program that causes a game machine to function as:

a display configured to display a plurality of symbol positions displayed in a grid including a plurality of rows and a plurality of columns;

a bill acceptor configured to establish a credit balance associated with a monetary value;

a user input device configured to enable a player to enter a wager that reduces the credit balance;

a cash out device configured to receive an input to cause an initiation of a payout associated with the credit balance; and a controller, the controller configured to:

initiate a game in response to the entered wager;

define an initial result for the game, the initial result including a symbol in each of the symbol positions within the grid;

detect a trigger condition, the trigger condition being defined as each symbol position orientated along a first axis defined along a column of the grid displaying the same symbol;

generate at least one adjacent axis upon detecting the trigger condition including:

selecting a symbol position from the symbols positions orientated along the first axis as a rotation point;

randomly determining a rotational direction as one of clockwise rotational direction and a counter clockwise rotational direction;

randomly selecting a rotation angle from a list of rotation angles, the list of rotation angles including at least one rotation angle that is not evenly divisible by 90 degrees;

determining an orientation of the at least one adjacent axis by rotating the at least one adjacent axis from the first axis about the selected rotation point in the determined rotational direction by the selected rotation angle;

determining a number of symbol positions included in the at least one adjacent axis based on a number of symbols positions included in the first axis; and for each of the determined number of symbol positions orientated along the at least one adjacent axis, randomly determining whether to copy the same symbol into a corresponding symbol position as a function of a paste position probability associated with the corresponding symbol position;

determine an outcome of the game based on the initial result and the copied symbols displayed in the grid; and upon receipt of the input from the cashout device, initiate a cashout of the credit balance based on the game outcome.

18. The non-transitory information recording medium, as in claim 17, wherein a pivot point is selected from a plurality of pivot points, and wherein the at least one adjacent axis is rotated about the selected pivot point by the selected rotation angle.

19. The non-transitory information recording medium, as in claim 17, wherein the controller is configured to generate a first adjacent axis and a second adjacent axis upon detecting the trigger condition and randomly determine whether to copy the same symbol into each symbol position orientated along the first adjacent axis and the second adjacent axis.

20. The non-transitory information recording medium, as in claim 19, wherein the first adjacent axis includes a different rotation angle than the second adjacent axis.

* * * * *